US010226941B2

(12) United States Patent
Valero Navazo et al.

(10) Patent No.: US 10,226,941 B2
(45) Date of Patent: Mar. 12, 2019

(54) TO CALIBRATE A PRINTER

(71) Applicant: HEWLETT-PACKARD DEVELOPMENT COMPANY, L.P., Houston, TX (US)

(72) Inventors: Jose Luis Valero Navazo, Sant Cugat del Valles (ES); Alejandro Manuel De Pena, Sant Cugat del Valles (ES); Marcos Casaldaliga Albisu, Sant Cugat del Valles (ES)

(73) Assignee: Hewlett-Packard Development Copmany, L.P., Houston, TX (US)

( * ) Notice: Subject to any disclaimer, the term of this patent is extended or adjusted under 35 U.S.C. 154(b) by 2 days.

(21) Appl. No.: 15/314,867

(22) PCT Filed: Jun. 4, 2014

(86) PCT No.: PCT/EP2014/061630
§ 371 (c)(1),
(2) Date: Nov. 29, 2016

(87) PCT Pub. No.: WO2015/185134
PCT Pub. Date: Dec. 10, 2015

(65) Prior Publication Data

US 2017/0100942 A1 Apr. 13, 2017

(51) Int. Cl.
*B41J 29/393* (2006.01)
*B41J 2/21* (2006.01)

(52) U.S. Cl.
CPC ..... *B41J 2/2135* (2013.01); *B41J 2/2132* (2013.01)

(58) Field of Classification Search
USPC ..... 347/9, 14, 19
See application file for complete search history.

(56) References Cited

U.S. PATENT DOCUMENTS

| | | | | |
|---|---|---|---|---|
| 5,854,882 | A | 12/1998 | Wang | |
| 6,287,027 | B1 | 9/2001 | Komiya et al. | |
| 6,464,319 | B1 | 10/2002 | Teshigawara et al. | |
| 8,208,176 | B2 | 6/2012 | Takahashi et al. | |
| 8,454,110 | B2 | 6/2013 | Ochiai et al. | |
| 8,573,731 | B2 | 11/2013 | Bastani et al. | |
| 2004/0022570 | A1 | 2/2004 | Ioka et al. | |
| 2004/0252152 | A1 | 12/2004 | Vilanova et al. | |
| 2005/0057600 | A1 * | 3/2005 | Teshigawara | B41J 29/393 347/19 |
| 2010/0079774 | A1 | 4/2010 | Yamazaki | |
| 2014/0015887 | A1 | 1/2014 | Seccombe | |

OTHER PUBLICATIONS

Boley, et al. Coalescence constraints for Inkjet Print Mask Optimization, 2010 IEEE/ASME International Conference on Advanced Intelligent Mechatronics Montréal, Canada, Jul. 6-9, 2010.

* cited by examiner

*Primary Examiner* — Lam S Nguyen
(74) *Attorney, Agent, or Firm* — HP Inc. Patent Department

(57) ABSTRACT

A method to calibrate a printer, in which printing of a plurality of uniform area fills using a variety of combinations of at least first and second types of correction is controlled, both the first and second type of correction being varied in the variety of combinations; and in which measurement of optical density uniformity of the plurality of uniform area fills is controlled.

15 Claims, 4 Drawing Sheets

TO CALIBRATE A PRINTER

BACKGROUND

Print head alignment may be used to calibrate a printer. Different print head alignment algorithms may be used.

BRIEF DESCRIPTION

Reference will now be made by way of example only to the accompanying drawings in which.

DETAILED DESCRIPTION

Figure 1:
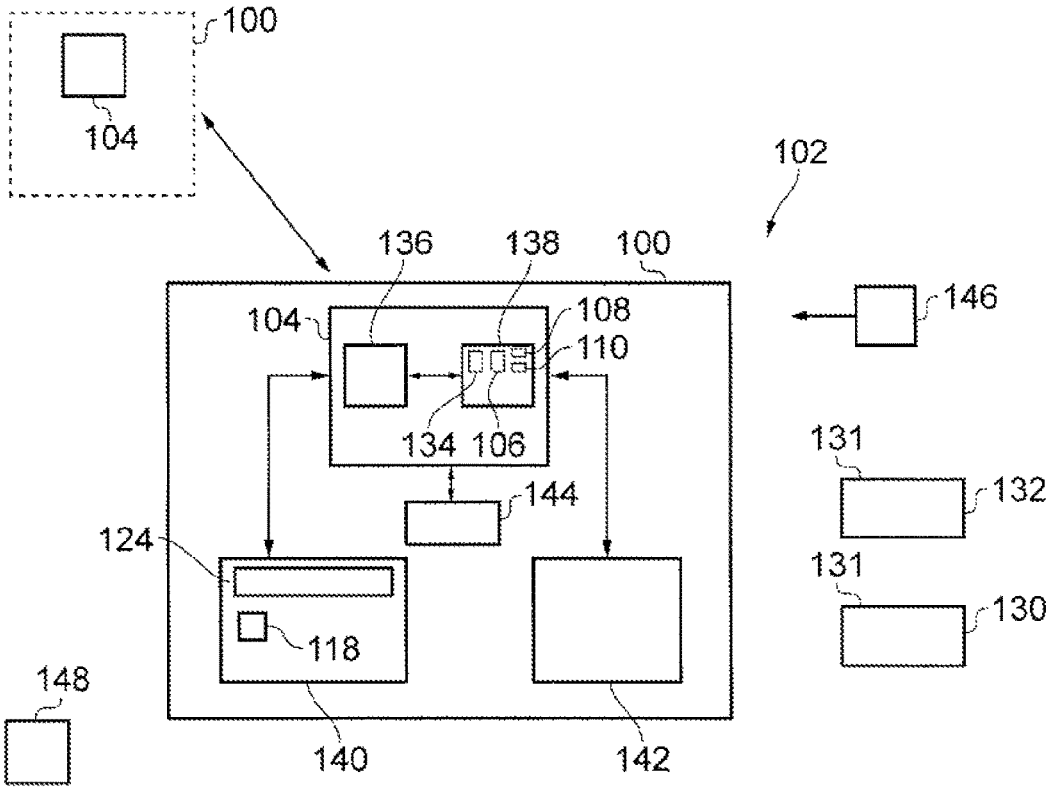
FIG. 1 illustrates an apparatus according to an example.

FIG. 1 illustrates an apparatus 100 to calibrate a printer 102. In an example, the apparatus 100 comprises a controller 104 to control printing of a plurality of uniform area fills 112 (see, for example, FIG. 3) using a variety of combinations of at least first and second types of correction, wherein both the first and second type of correction are varied in the variety of combinations; and to control measurement of optical density uniformity 114 of the plurality of uniform area fills 112.

In another example, the apparatus 100 comprises a controller 104 to apply at least a print head alignment correction and a second, different correction to printing data 106 to produce first corrected printing data 108;

to control printing of at least one uniform area fill 112 using the first corrected printing data 108;

to apply at least a print head alignment correction and second, different correction to printing data 106 to produce second corrected printing data 110, wherein both of the print head alignment correction and the second correction are varied from the corrections used to produce the first corrected printing data 108;

to control printing of at least one uniform area fill 112 using the second corrected printing data 110; and to control measurement of optical density uniformity 114 of the first and second uniform area fills 112.

FIG. 1 illustrates an example of an apparatus 100. The apparatus 100 may be a processing apparatus 100 and may be an apparatus 100 to calibrate a printer 102. The apparatus 100 may, for example, be incorporated into a printer 102. The apparatus 100 may comprise a controller 104, a medium manager 142, a print engine 140 and a sensor 144.

The controller 104 controls operation of the apparatus 100.

In some examples, the apparatus 100 may be a printer 102 and in such examples the apparatus 100 may be to calibrate itself. In examples where the apparatus 100 is a printer 102 the apparatus 100 may comprise a medium manager 142, a print engine 140 and a sensor 144 any number of additional elements not illustrated in the example of FIG. 1. The apparatus 100 may comprise any suitable printer such as, for example, a one pass or two pass page wide array printer or scanning printer.

In other examples, the apparatus 100 may not comprise the medium manager 142, print engine 140 and sensor 144 as indicated by the dotted line in the example of FIG. 1. That is, in some examples, the apparatus 100 may be separate from a printer 102 that comprises the medium manager 142, print engine 140 and sensor 144.

For example, the apparatus 100 may be comprised in a computing device such as a personal computer, a laptop computer, a desktop computer, a digital camera, a personal digital assistant device, a cellular phone and so on.

In examples where the apparatus 100 is separate from a printer 102, the apparatus 100 may be arranged to communicate with the printer 102 comprising the medium manager 142, print engine 140 and sensor 144. For example, the apparatus 100 may be arranged to communication with the printer 102 by wired or wireless communication as indicated by the arrow in FIG. 1.

In such examples, the printer 102, which is separate from the apparatus 100, may also comprise a controller 104 as described herein and may also be capable of processing information. Therefore, in some examples, the apparatus 100 and the separate printer 102 may both comprise a controller 104 as illustrated in FIG. 1.

In examples, processing of information may be performed by the apparatus 100 separate from the printer 102, by the apparatus 100 that includes the controller 104, the medium manager 142, the print engine 140 and the sensor 144 or by both the apparatus 100 and a separate printer 102, comprising a controller 104, in combination.

Implementation of the controller can be in hardware alone (a circuit, a processor and so on), have certain aspects in software including firmware alone or can be a combination of hardware and software (including firmware).

The controller 104 may be implemented using instructions that enable hardware functionality, for example, by using executable computer program instructions in a general-purpose or special-purpose processor that may be stored on a computer readable storage medium (disk, memory etc) to be executed by a processor.

The processor 136 is configured to read from and write to the memory 138. The processor 136 may also comprise an output interface (not illustrated) via which data and/or commands are output by the processor 136 and an input interface (not illustrated) via which data and/or commands are input to the processor 136.

The memory 138 stores a computer program 134 comprising computer program instructions that control the operation of the apparatus 100 when loaded into the processor 136. The computer program instructions provide the logic and routines that enables the apparatus 100 to perform the methods illustrated in FIGS. 4 and 5. The processor 136 by reading the memory 138 is able to load and execute the computer program 134.

The apparatus therefore comprises:

at least one processor; and at least one memory including computer program code the at least one memory and the computer program code configured to, with the at least one processor, cause the apparatus at least to perform:

controlling printing of a plurality of uniform area fills using a variety of combinations of at least first and second types of correction, wherein both the first and second type of correction are varied in the variety of combinations; and controlling measurement of optical density uniformity of the plurality of uniform area fills.

For example, the apparatus may comprise:

at least one processor; and at least one memory including computer program code the at least one memory and the computer program code configured to, with the at least one processor, cause the apparatus at least to perform:

applying at least a print head alignment correction and a second, different correction to printing data to produce first corrected printing data;

controlling printing of at least one uniform area fill using the first corrected printing data;

applying at least a print head alignment correction and a second, different correction to printing data to produce second corrected printing data, wherein both of the print head alignment correction and the second correction are varied from the corrections used to produce the first corrected printing data; controlling printing of at least one uniform area fill using the second corrected printing data; and controlling measurement of optical density uniformity of the first and second uniform area fills.

The computer program 134 may arrive at the apparatus 100 via any suitable delivery mechanism 148. The delivery mechanism 148 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 134. The delivery mechanism may be a signal configured to reliably transfer the computer program 134. The apparatus 100 may propagate or transmit the computer program 134 as a computer data signal.

Although the memory 138 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device and so on.

Figure 4:
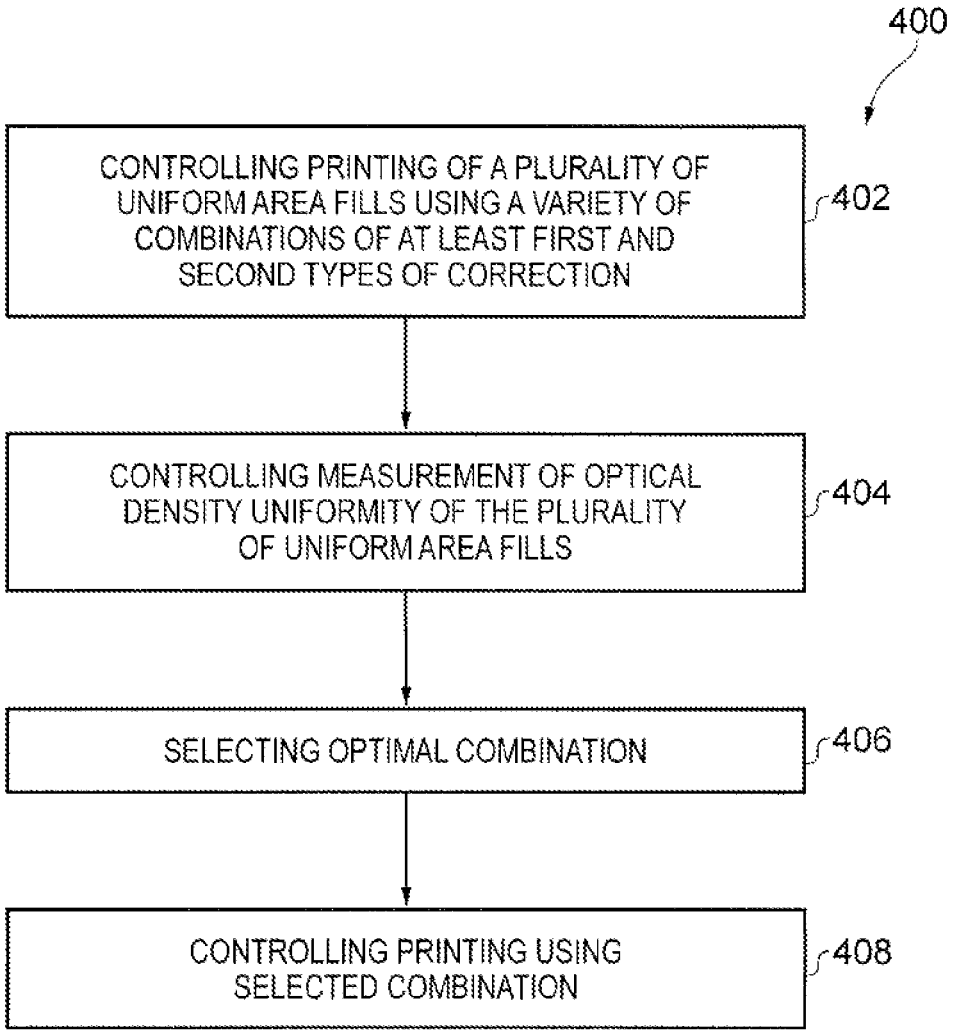
FIG. 4 illustrates a method according to an example.
Figure 5:
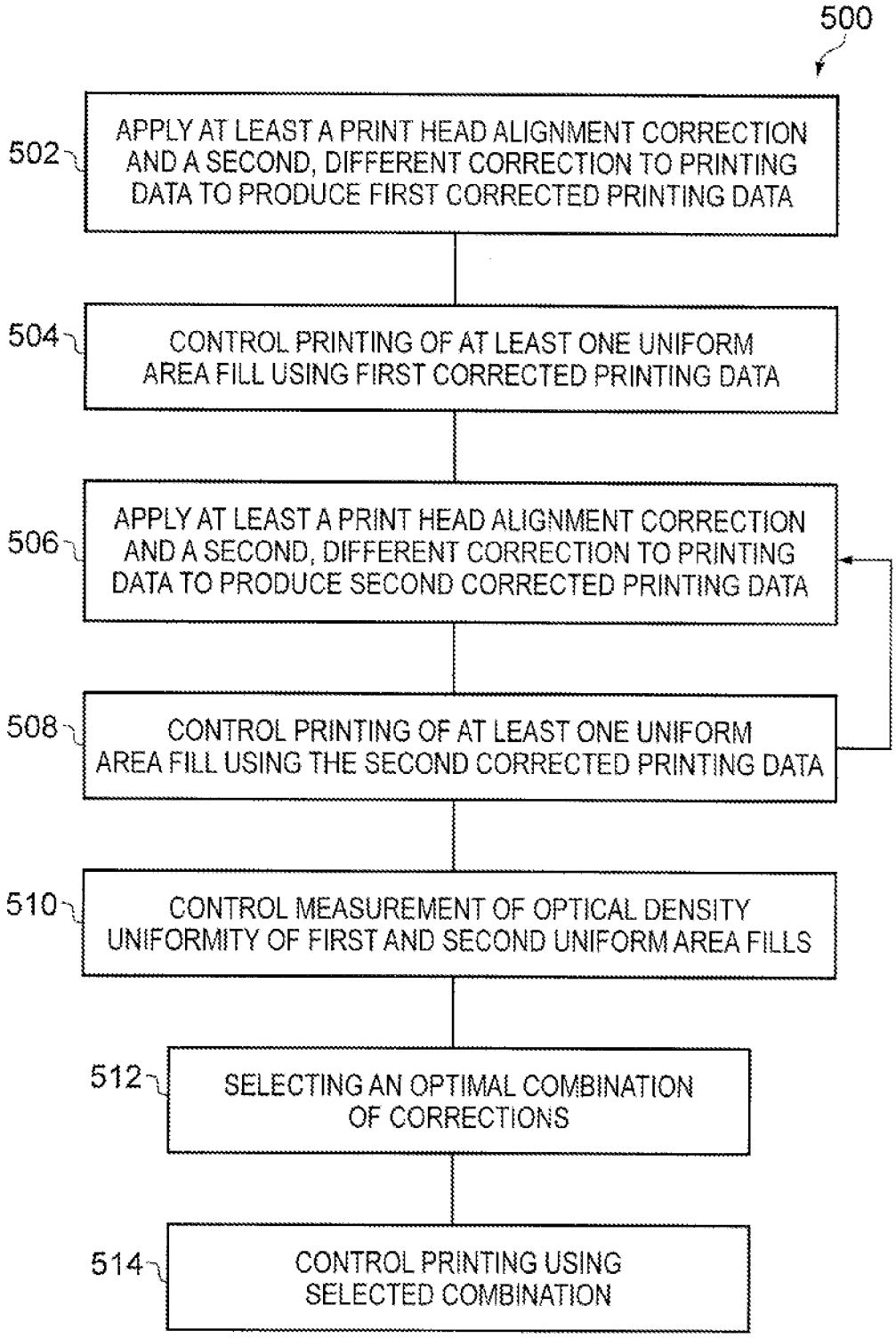
FIG. 5 illustrates a method according to an example.

The apparatus 100 may comprise any suitable means for performing the method of any of FIGS. 4 and 5 alone or in combination.

For example, the controller 104 may provide means for performing the method of any of FIG. 4 or 5 alone or in combination. The controller 104 may provide the means for controlling the apparatus 100 described herein.

The controller 104 may be a controller to control printing of a plurality of uniform area fills 112 using a variety of combinations of at least first and second types of correction, wherein both the first and second type of correction are varied in the variety of combinations and to control measurement of optical density uniformity 114 of the plurality of uniform area fills 112.

The controller 104 may control printing by controlling the various elements of the printer 102, such as the medium manager 142 and the print engine 140, to allow printing fluid 118, for example ink, to be deposited on medium 131 as required.

In some examples the controller 104 may be to apply a first type of correction, such as a print head alignment correction, and a second, different correction to printing data 106 to produce first corrected printing data 108. In some examples, the second correction is one of controlling the way that printing fluid 118 is printed in at least one overlap area 120 between dies 122 in a print head 124 and controlling the amount of printing fluid 118 printed in at least one overlap area 120 between dies 122 in a print head 124 (see, for example, FIG. 2). For example, the way that printing fluid 118 is printed in at least one overlap area 120 may be controlled using at least one weaving mask. In some examples the printing fluid 118 may be ink.

The controller 104 may be to control printing of at least one uniform area fill 112 using the first corrected printing data 108.

The controller 104 may also be to apply a first correction and a second correction to printing data 106 to produce second corrected printing data 110.

The controller 104 may be to vary the corrections used to produce the second corrected printing data 110 compared to those used to produce the first corrected printing data 108. For example, in examples where the first correction is a print head alignment correction and the second correction is using a weaving mask, a different/varied print head alignment correction and weaving mask may be used to produce the second corrected printing data 110.

The controller 104 may control printing of at least one uniform area fill 112 using the second corrected printing data 110 and control measurement of optical density uniformity 114 of the first and second uniform area fills 112.

In examples, the printing data 106 may be stored in the memory 138. In other examples, the printing data 106 may be generated by the controller 104 or may be received by the apparatus 100. In examples, the first and second corrected printing data 108, 110 may be stored in the memory 138.

The processor 136 and the memory 138 are operationally coupled and any number or combination of intervening elements can exist (including no intervening elements).

The medium manager 142, print engine 140 and sensor 144 are operatively coupled to the controller 104 to allow data such as control signals and other information to be passed between the controller 104 and the medium manager 142, the print engine 140 and the sensor 144.

Any number or combination of intervening elements can exist (including no intervening elements) between the medium manager 142 and the controller 104, the print engine 140 and the controller 104 and the sensor 144 and the controller 104.

The medium manager 142 is arranged to control movement and positioning of medium 131 to allow the print engine 140 to print on the medium 131. In the example of FIG. 1, a first printing medium 130 and a second printing medium 132 are illustrated. In examples, the first printing medium 130 and the second printing medium 132 may be different.

The medium 131 may be any suitable substrate and may include any variety of paper (lightweight, heavyweight, coated, uncoated, paperboard, cardboard and so on), films, foils, textiles, fabrics or plastics.

The medium manager 142 comprises any suitable means for controlling the movement of and/or position of the medium 131. For example, the medium manager 142 may comprise one or more rollers (not illustrated).

The print engine 140 is arranged to deposit printing fluid 118 on medium 131. In the example illustrated in FIG. 1, the print engine 140 comprises a print head 124 and printing fluid 118. In some examples the print engine 140 may comprise a plurality of print heads 124.

The printing fluid 118 may be any suitable printing fluid 118 for use by the print engine 140. For example, the printing fluid 118 may be ink and the ink may comprise cyan (C), magenta (M), yellow (Y) and/or black (K) ink/inks. However, in some examples alternative inks may be used. In addition, in examples any number of inks may be used.

In some examples, the print engine 140 may not comprise the printing fluid 118. The print engine 140 may be arranged to receive the printing fluid 118, for example, the print engine 140 may be arranged to receive a cartridge or cartridges comprising the printing fluid 118 such as an ink cartridge or cartridges.

The sensor 144 is arranged to measure the output of the print engine 140. The sensor 144 may be arranged to measure optical density uniformity 114 of uniform area fills 112 printed by the print engine 140. For example. The sensor 144 may be arranged to measure how the lightness/darkness of a uniform area fill or fills 122 varies across the fill or fills 122. In other examples the sensor 144 may be arranged to measure the color density uniformity of uniform area fills 112 printed by the print engine 140. In some examples, the sensor may be a densitometer or a spot sensor, however any suitable sensor 144 may be used.

In other examples, the sensor 144 may be separate from the apparatus 100.

In some examples, the medium manager 142 may move the medium 131 so that the sensor 144 may measure the output of the print engine 140. In other examples, the sensor 144 may be moved relative to the medium 131 to measure the output of the print engine 140. A combination of movement of the sensor 144 and the medium 131 may also be used.

Operation of the apparatus 100 illustrated in the example of FIG. 1 is described in the following paragraphs with reference to FIGS. 2, 3, 4 and 5.

Figure 2:
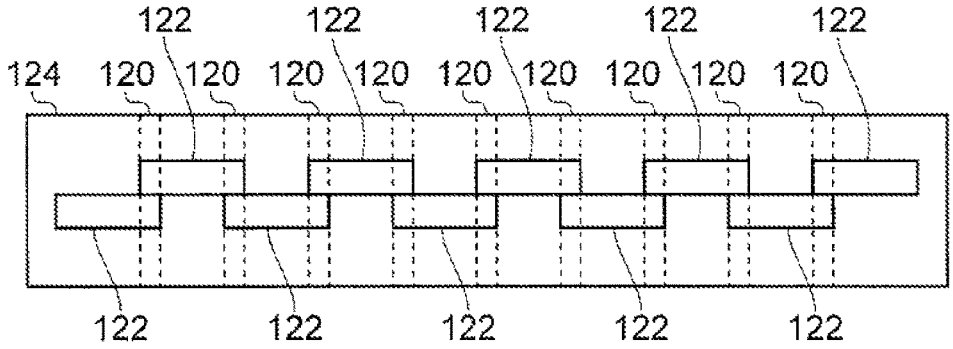
FIG. 2 illustrates a print head according to an example.

FIG. 2 illustrates an example of a print head 124. The print head 124 illustrated in the example of FIG. 2 may be comprised in the print engine 140 of the apparatus 100 of FIG. 1.

The print head 124 illustrated in the example of FIG. 2 is a print head 124 of a page wide array printer. The print head 124 comprises a plurality of dies 122 arranged along the length of the print head 124. The dies 122 are arranged to have overlapping portions 120 between consecutive dies 122.

In examples, the print head 124 of FIG. 2 may be used in printing using a low number of passes, for example one or two pass printing such as one or two pass inkjet printing. In one pass printing systems the overlap area 120 between consecutive dies 122 can cause visible image quality defects such as repeatable vertical bands. This is due to the large sensitivity of one pass printing, for example, to dot placement errors in the overlap area 120.

Dot placement errors may be caused by different sources. For example, mechanical tolerances in printer head placement, media advance errors, drop trajectory differences between dies 122 and inside a die 122, drop trajectory differences depending on fire and frequency and so on.

In addition, printing systems that use a low number of passes may be sensitive to dot placement errors between print heads 124 in examples where multiple print heads 124 are used.

The sensitivity to dot placement errors is not as problematic in multi pass printing, as in multi pass printing systems, errors are distributed along successive printing passes. However, in printing systems using a low number of passes, such as one pass or two pass printing systems, visible image quality defects may be generated due to the overlap area 120 between dies 122 and/or print heads 124. This can be particularly problematic in one pass printing systems.

In some examples, applying a print head alignment correction to printing data 106 to be used with, for example, a one pass printing system such as the page wide array illustrated in the example of FIG. 2 may not be sufficient to eradicate the image defects due to the overlap area 120 between dies 122 and/or print heads 124. The image defects are particularly noticeable when printing, for example, uniform area fills, such as those illustrated in the example of FIG. 3, and graphics.

To obtain print head alignment corrections special diagnostic patterns designed to give accurate position readings, measure the print head 124 positioning error and correct for it may be used. In some examples, the correction may comprise the shifting of printing data 106. For example, printing data 106 that is assigned to a die 122 may be shifted to compensate for position errors.

However, print head alignment corrections do not account for other types of errors that contribute to dot placement error, for example dynamic swath height error, media advance errors, differences between drop size of different print heads 124 and so on.

Figure 3:
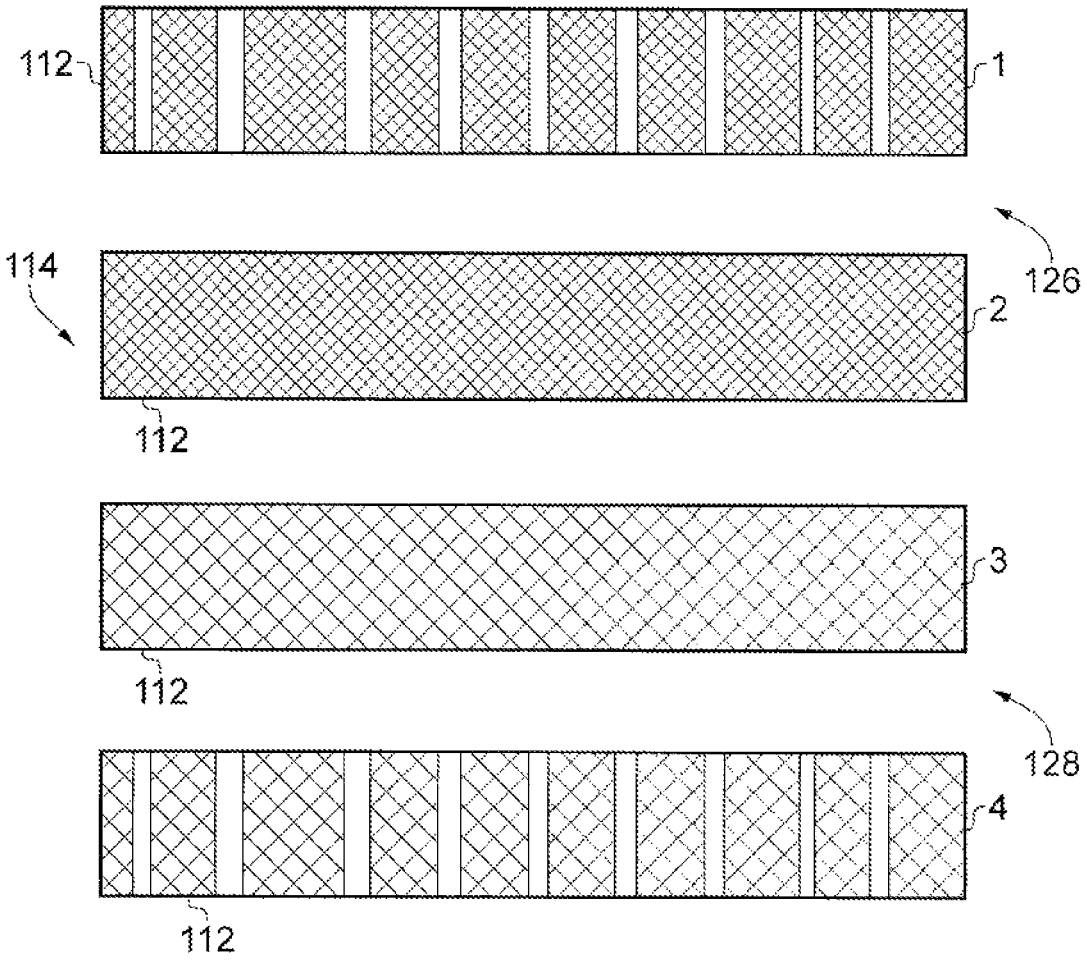
FIG. 3 illustrates a plurality of uniform area fills according to an example.

FIG. 3 illustrates an example of a plurality of printed uniform area fills 112. For example, the uniform area fills 112 illustrated in the example of FIG. 3 may be printed by the printer 102 illustrated in FIG. 1 using the print head 124 illustrated in FIG. 2. For ease of reference the uniform area fills 112 in FIG. 3 have been labelled 1 to 4.

In the example illustrated in FIG. 3, the top two uniform area fills 112 have been printed using a first color density 126 and the bottom two uniform area fills 112 have been printed at a second color density 128. The first and second color densities have been illustrated in FIG. 3 using different hatching, the first hatching (first and second uniform area fills 112) representing a first color density and the second hatching (third and fourth uniform area fills 112) representing a second color density.

In the illustrated example, print quality defects (vertical bands) can be seen in the first uniform area fill 112 and the fourth uniform area fill 112. This represents a variation in the optical density of the first and fourth uniform area fills 112.

FIG. 4 illustrates an example of a method 400 to calibrate a printer 102. In examples, the method 400 may be performed by the apparatus 100 of FIG. 1.

At block 402, printing of a plurality of uniform area fills 112 using a variety of combinations of at least first and second types of correction is controlled. In examples, both the first type and the second type of correction are varied in the variety of combinations.

In some examples, the first type of correction may be a print head alignment correction to calibrate the print head alignment of the printer 102 and the second type of correction, and any further correction types used, may be a correction to calibrate the printing pipeline algorithm used by the printer 102.

For example, the second type of correction may be one of controlling the way printing fluid 118 is printed in at least one overlap area 120 between dies 122 in a print head 124, for example using at least one weaving mask, and controlling the amount of printing fluid 118 printed in at least one overlap area 120 between dies 122 in a print head 124.

Referring to the example of FIG. 2, the dies 122 may comprise a plurality of nozzles to distribute printing fluid 118. In the overlap areas 120 there are twice as many nozzles because there are nozzles of two different dies 122 in that area. The controller 104 may control the way printing fluid 118 is printed in the overlap areas 120. For example, weaving masks may be used to control which nozzle/nozzles from the two available dies 122 in an overlap area 120 are used to distribute printing fluid 118. A weaving mask may therefore dictate the structure of the transition from printing completely with one die 122 to doing so with the adjacent die 122 next to it.

In some examples, dot positioning errors may cause less printing fluid 118 to be deposited in the overlap area 120 between dies 122. For example, dot positioning errors may cause lighter color in the overlap area 120 between dies 122. To compensate for this, the amount of printing fluid 118 printed in the overlap areas 120 may be controlled. For example, additional dots may be added in the overlap area 120.

In examples, uniform area fills 112 are printed using a variety of combination of the first and second types of correction.

For example, varied print head alignment corrections and weaving masks/control of amount of printing fluid 118 in overlap area/areas 120 may be used to form a variety of combinations of two types of correction and uniform area fills 112 printed using the different combinations of corrections.

In some examples, a third type of correction may be used and the first, second and third types of correction varied in the variety of combinations.

For example, a print head alignment correction, a weaving mask and control of amount of printing fluid 118 in the overlap area/areas 120 may be varied to produce a variety of combinations that are used to print a plurality of uniform area fills 112, such as those illustrated in the example of FIG. 3.

In some examples, a print head alignment correction and a second, different correction may be applied to printing data 106 to produce first corrected printing data 108. The first corrected printing data 108 may be used to print a uniform area fill 112.

A different/varied print head alignment correction and a different/varied second correction may be applied to printing data 106 to produce second corrected printing data 110. The second corrected printing data 110 may be used to print a uniform area fill 112.

In examples, any number of different types of correction may be used and varied to produce a variety of combinations of corrections and associated uniform area fills 112.

For example, any number of corrections may be applied to printing data 106 in different and varied combinations to produce corrected printing data that may be used to print uniform area fills 112.

In the example of FIG. 3, the first uniform area fill 112 has been printed with a first combination of corrections, for example, a first combination of print head alignment correction, weaving mask and/or amount of printing fluid 118 printed in the overlap areas 120 between dies 122. The second uniform area fill 112 has been printed using a different combination of corrections. For example, using a print head alignment correction and/or a weaving mask and/or an amount of printing fluid 118 in the overlap areas 120 that are varied compared to the first combination of corrections.

At block 404 of FIG. 4 measurement of optical density uniformity 114 of the plurality of uniform area fills 112 is controlled. For example, the sensor 144 in the example of FIG. 1 may be controlled to measure the optical density uniformity 114 of the plurality of uniform area fills 112.

It can be seen in the example of FIG. 3 that the first uniform area fill 112 contains image quality defects but the second uniform area fill 112 does not. In this example, the optical density uniformity 114 of the second uniform area fill 112 is better than the optical density uniformity 114 of the first uniform area fill 112.

At block 406, the optimal combination of corrections is selected. In the example of FIG. 3, considering the first and second uniform area fills 112, the corrections used when printing the second uniform area fill would be selected as they have produced the best optical density uniformity 114.

In examples where a greater number and variety of combinations of corrections are used, the optimal combination from all uniform area fills 112 that are printed may be selected.

At block 408, printing using the selected combination is controlled. For example, the printer 102 may use the selected combination when printing generally.

In examples, therefore, print head alignment and printing pipeline algorithms may be calibrated at the same time.

The printer 102 may use the selected combination when printing an image 146. The image 146 may be received at the printer 102 by any suitable means. For example, the image may be uploaded to the apparatus 100 or received by the apparatus 100 from the memory 138 or a remote storage location such as an online storage location using the internet for example. In some examples, it may not be an image that is received, but may be anything for printing onto medium 131, for example text and so on.

In some examples, the method 400 may be performed for a first color density and a second, different color density. For example, the method may be performed for a first color density and uniform area fills 112 printed as in the first and second uniform area fills 112 in the example of FIG. 3. The method 400 may also be performed for a second, different color density as in the third and fourth uniform area fills 112 in the example of FIG. 3.

With regard to the first color density, the first uniform area fill 112 of FIG. 3 may be printed using a first combination of corrections and the second uniform area fill 112 may be printed using a second, different combination of corrections. With regard to the second color density, the third uniform area fill may be printed using the same first combination of corrections and the fourth uniform area fill 112 may be printed using the same second combination of corrections.

In other examples, different sets of combinations of corrections may be used for the first color density and the second color density.

The method 400 may further comprise selecting a first optimal combination for the first color density and selecting a second optimal combination for the second color density and controlling printing of the first color density using the first optimal combination and controlling printing of the second color density using the second optimal combination.

The optimal combination for the first color density may be different than the optimal combination for the second color density.

For example, continuing with the example of first and second combinations of corrections used to print the uniform area fills 112 illustrated in FIG. 3, the first combination of corrections is not optimal for the first color density but is optimal for the second color density. In addition, the second combination of corrections is not optimal for the second color density but is optimal for the first color density. This can be seen from the image defects present in the first and fourth uniform area fills 112 in FIG. 3.

When printing the first color density, the printer 102 may use the second combination of corrections and when printing the second color density, the printer 102 may use the first combination of corrections.

In some examples, the method may be performed on a first printing medium 130 and also on a second printing medium 132. The method 400 may comprise selecting a first optimal combination for the first printing medium 130 and selecting a second optimal combination for the second printing medium 132, controlling printing on the first printing medium 130 using the first optimal combination and controlling printing on the second printing medium 132 using the second optimal combination.

In other examples, an optimal combination of corrections may be selected and used for different colors or for any combination of different factors. For example, an optimal combination of corrections could be tested and selected for use of a particular color density on a particular printing medium and so on.

FIG. 5 illustrates another example of a method 500.

In examples, the method 500 may be performed by the controller 104 of the apparatus 100 illustrated in the example of FIG. 1.

At block 502, at least a print head alignment correction and a second, different correction is applied to printing data 106 to produce first corrected printing data 108. For example, the second correction may be one of using at least one weaving mask and controlling the amount of printing fluid 118 printed in at least one overlap area 120 between dies 122 in a print head 124.

At block 504, printing of at least one uniform area fill 112 using the first corrected printing data 108 is controlled. For example, the first uniform area fill 112 in FIG. 3 may be printed.

At block 506, at least a print head alignment correction and second, different correction is applied to printing data 106 to produce second corrected printing data 110. Both of the print head alignment correction and the second correction may be varied from the corrections used to produce the first corrected printing data 106. For example, the print head alignment used may be changed and a different and/or varied weaving mask and/or a different amount of printing fluid 118 in the overlap areas 120 may be used.

At block 508, printing of at least one uniform area fill 112 using the second corrected printing data 132 is controlled. For example, the second uniform area fill 112 in the example of FIG. 3 may be printed.

At block 510, measurement of optical density uniformity 114 of the first and second uniform area fills 112 is controlled. For example, the sensor 144 and/or the medium manager 142 may be controlled to allow measurement of the optical density uniformity 114 of the first and second uniform area fills 112.

At block 512, an optimal combination of corrections is selected. For example, considering the first and second uniform area fills 112 of FIG. 3 the corrections used to print the second uniform area fill 112 is selected.

In some examples, a print head alignment correction, a second, different correction and a third, different correction may be applied to printing data 106 to produce the corrected printing data 108, 110. In such examples, at least two of the corrections may be varied between the different combinations of corrections.

For example, the second correction may be using a weaving mask and the third correction may be controlling the amount of printing fluid 118 printed in at least one overlap area 120 between dies 122 in a print head 124 and at least two of the different corrections varied between the first corrected printing data 108 and the second corrected printing data 110.

In some examples, all three corrections may be varied between the first corrected printing data 108 and the second corrected printing data 110.

In examples, any number of different variations of corrections may be applied to printing data 106 to produce corrected printing data and associated uniform area fills 112. This is illustrated in the example of FIG. 5 by the arrow returning from block 508 to block 506.

In examples, as described above in relation to FIG. 4 the method of FIG. 5 may be repeated for different color densities, and/or colors and/or printing mediums to optimise for the different factors.

The methods, apparatuses and computer programs described herein allow for, in some examples, calibration of print head alignment and printing pipeline algorithms at the same time. In addition, they allow for correction of print head alignment but also other errors that may lead to print quality defects. For example, errors such as media advance or non-uniformities of drop trajectory or dot shape between print heads or inside a single die 122.

The methods, apparatuses and computer programs described herein improve the quality of printing using low number of passes, for example, one pass or two pass print systems such as page wide arrays and expand the applications of such systems. The methods described herein apply equally to low pass print modes of scanning systems.

The blocks illustrated in the FIGS. 4 and 5 may represent steps in a method and/or sections of code in the computer program 134. The illustration of a particular order to the blocks does not necessarily imply that there is a required or preferred order for the blocks and the order and arrangement of the block may be varied. Furthermore, it may be possible for some blocks to be omitted. For example blocks 406 and 408 in FIG. 4 and blocks 512 and 514 in FIG. 5 may be omitted in some examples.

Although examples of the present invention have been described in the preceding paragraphs, it should be appreciated that modifications to the examples given can be made without departing from the scope of the invention as claimed.

For example, a print head alignment calibration may be performed prior to the method of FIG. 4 and/or FIG. 5 to reduce the number of print head alignment variations to be included in the different combinations of corrections.

Furthermore, the uniform area fills 112 may be any shape and/or size and may be different than those illustrated in the example of FIG. 3. In some examples, the uniform area fills 112 for different combinations of corrections may be different shapes and/or sizes.

In some examples the printer 102 may be a three dimensional printer. In such examples the print engine 140 may be arranged to deposit powdered build material and the sensor 144 may be arranged to measure the uniformity of the deposition of the powdered build material. For example, the print engine 140 may be arranged to deposit powdered build material in layers to produce a three dimensional structure.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A method to calibrate a printer, comprising:

controlling printing of a plurality of uniform area fills using a variety of combinations of at least first and second types of correction, wherein both the first and second type of correction are varied in the variety of combinations;

controlling measurement of optical density uniformity of the plurality of uniform area fills;

selecting a combination of corrections; and controlling subsequent printing using the selected combination, wherein the first type of correction is a print head alignment correction and the second type of correction is one of controlling the way printing fluid is printed in at least one overlap area between dies in a print head and controlling amount of printing fluid printed in at least one overlap area between dies in a print head.

2. A method as claimed in claim 1, further comprising using a third type of correction, wherein the first, second and third types of correction are varied in the variety of combinations.

3. A method as claimed in claim 2, wherein the third type of correction is using at least one weaving mask.

4. A method as claimed in claim 2, wherein the third type of correction is a correction to a printing pipeline algorithm used by the printer.

5. A method as claimed in claim 1, wherein the method is performed for a first color density and a second, different color density, the method further comprising:

selecting a first combination for the first color density;

selecting a second combination for the second color density;

controlling printing of the first color density using the first combination; and controlling printing of the second color density using the second combination.

6. A method as claimed in claim 1, wherein the method is performed for a first printing medium and a second, different printing medium, the method further comprising:

selecting a first combination for the first printing medium;

selecting a second combination for the second printing medium;

controlling printing on the first printing medium using the first combination; and controlling printing on the second printing medium using the second combination.

7. A method as claimed in claim 1, wherein controlling measurement of optical density uniformity of the plurality of uniform area fills comprises moving an optical sensor relative to the plurality of uniform area fills.

8. A method as claimed in claim 1, wherein controlling measurement of optical density uniformity of the plurality of uniform area fills comprises moving both an optical sensor and the plurality of uniform area fills relative to each other.

9. A method as claimed in claim 1, wherein controlling printing of a plurality of uniform area fills, controlling measurement of optical density uniformity and selecting a combination of corrections is performed separately for each color printed by the printer.

10. An apparatus to calibrate a printer, comprising:

a controller to:

apply at least a print head alignment correction and a second, different correction to printing data to produce first corrected printing data;

control printing of at least one uniform area fill using the first corrected printing data;

apply at least a print head alignment correction and a second, different correction to printing data to produce second corrected printing data, wherein both of the print head alignment correction and the second correction are varied from the corrections used to produce the first corrected printing data;

control printing of at least one uniform area fill using the second corrected printing data;

control measurement of optical density uniformity of the first and second uniform area fills;

select a combination of corrections; and control subsequent printing using the selected combination of corrections, wherein the second correction is one of using at least one weaving mask and controlling amount of printing fluid printed in at least one overlap area between dies in a print head.

11. An apparatus as claimed in claim 10, wherein the controller is to apply the print head alignment correction, the second correction and a third, different correction to printing data to produce the first and second corrected printing data, and wherein the processor is to vary at least two of the print head alignment correction, the second correction and the third correction from the corrections used to produce the first corrected printing data when producing the second corrected printing data.

12. An apparatus as claimed in claim 10, wherein the second type of correction is a correction to a printing pipeline algorithm used by the printer.

13. A computer program product comprising a non-transitory, computer-readable medium bearing instructions, that when executed by at least one processor, directs the at least one processor to perform a method comprising:

controlling printing of a plurality of uniform area fills using a variety of combinations of at least first and second types of correction, wherein both the first and second type of correction are varied in the variety of combinations;

controlling measurement of optical density uniformity of the plurality of uniform area fills;

selecting a combination of corrections based on the measurement of optical density uniformity of the plurality of uniform area fills; and control subsequent printing using the selected combination of corrections, wherein the first type of correction is a print head alignment correction and the second type of correction is one of using at least one weaving mask and controlling amount of printing fluid printed in at least one overlap area between dies in a print head.

14. A computer program as claimed in claim 13, wherein the computer program, when executed by at least one processor, further directs the at least one processor to perform using a third type of correction, wherein the first, second and third types of correction are varied in the variety of combinations.

15. A computer program product as claimed in claim 13, wherein the first type of correction is a print head alignment correction, and the second type of correction is a correction to a printing pipeline algorithm used by the printer.

* * * * *